US006298578B1

(12) United States Patent
Frampton

(10) Patent No.: US 6,298,578 B1
(45) Date of Patent: Oct. 9, 2001

(54) APPARATUS AND METHOD FOR DRYING A GROUND SURFACE

(76) Inventor: Mark H. Frampton, 4789 W. Tulsa St., Chandler, AZ (US) 85226

( * ) Notice: Subject to any disclaimer, the term of this patent is extended or adjusted under 35 U.S.C. 154(b) by 0 days.

(21) Appl. No.: 09/689,355

(22) Filed: Oct. 12, 2000

Related U.S. Application Data

(63) Continuation-in-part of application No. 09/382,388, filed on Aug. 24, 1999, now abandoned.

(51) Int. Cl.[7] ..... F26B 3/00

(52) U.S. Cl. ..... 34/465; 34/443; 34/448; 34/69; 34/92

(58) Field of Search ..... 34/443, 448, 465, 34/60, 69, 92; 15/345, 353, 409

(56) References Cited

U.S. PATENT DOCUMENTS

| | | | | |
|---|---|---|---|---|
| 4,133,072 | * | 1/1979 | Face, Jr. | 15/353 |
| 4,571,849 | * | 2/1986 | Gardner et al. | 34/79 |
| 5,533,577 | * | 7/1996 | Jucker | 172/21 |
| 5,548,905 | * | 8/1996 | Kuma et al. | 34/92 |
| 6,049,943 | * | 4/2000 | Carter | 15/340.3 |

* cited by examiner

*Primary Examiner*—Pamela Wilson
(74) *Attorney, Agent, or Firm*—Tod R. Nissle, P.C.

(57) ABSTRACT

A method and apparatus for drying a tennis court or other surface removes water from the tennis court and heats the surface of the tennis court to facilitate evaporation of water from the court.

3 Claims, 2 Drawing Sheets

APPARATUS AND METHOD FOR DRYING A GROUND SURFACE

Figure 1:
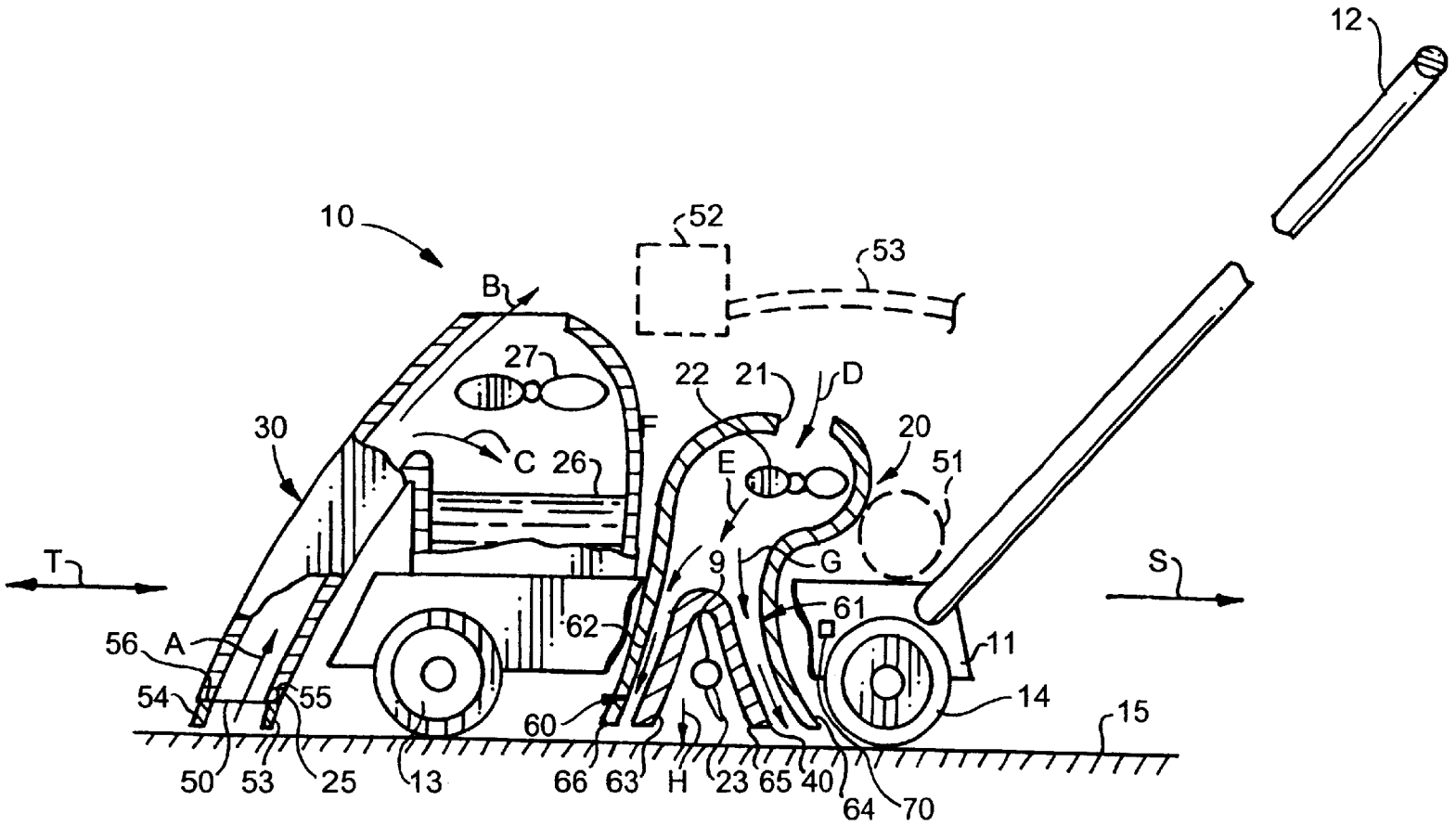

This application is a continuation-in-part of application Ser. No. 09/382,388, filed Aug. 24, 1999, now abandoned.

This invention relates to a method and apparatus for removing a liquid from a surface.

More particularly, the invention relates to a method and apparatus for drying a tennis court or other surface.

When concrete, asphalt, or similar "hard surface" outdoor tennis courts become wet, the courts are typically dried by using a squeegee having a long handle to push water off to the side of the court and by then allowing any remaining moisture to evaporate of its own accord from the court. Utilizing a squeegee to clear water from a tennis court or other hard surface has disadvantages. First, the squeegee usually will not remove all water from a tennis court. Some water escapes around the ends of the squeegee. Remaining water tends to puddle in low areas in the court. Second, if it is necessary to allow remaining water to evaporate from a tennis court, two or three or four hours may pass before the court is dry and can again be utilized. Third, in humid climates the evaporation of water from a tennis court can take a long time.

Accordingly, it would be highly desirable to provide an improved apparatus and method for drying a tennis court.

Therefore, it is a principal object of the invention to provide an improved apparatus and method for removing liquid from a surface.

A further object of the invention is to provide an improved apparatus and method for drying a hard surface like a tennis court.

Another object of the invention is to provide apparatus for removing water from a surface and for quickly drying the surface.

These and other, further and more specific objects and advantages of the invention will be apparent to those skilled in the art from the following detailed description thereof, taken in conjunction with the drawing.

Briefly, in accordance with my invention, I provide an improved apparatus for drying a surface. The apparatus includes a frame; at least one ground engaging wheel mounted on the frame to support the frame above the surface and facilitate movement of the frame over the surface; water removal apparatus mounted on the frame to remove water from the surface; heat producing apparatus mounted on the frame to produce heat which is absorbed by the surface and promotes the evaporation of water from the surface; and, motive power apparatus for moving the frame over the surface.

In another embodiment of the invention, I provide a method for drying a surface. The method includes the steps of providing liquid removal apparatus including a frame; at least one ground engaging wheel mounted on the frame to support the frame above the surface and facilitate movement of the frame over the surface; liquid removal apparatus mounted on the frame to remove permanently at least a portion of liquid on the surface; heat producing apparatus mounted on the frame to produce heat which is absorbed by the surface and promotes the evaporation of liquid from the surface; and, motive power apparatus for moving the frame over the surface. The method also includes the step of utilizing the motive power apparatus to move the liquid removal apparatus over the surface such that the liquid removal apparatus removes liquid from the surface and the heat producing means produces heat which is absorbed by the surface and promotes the evaporation of at least a portion of the liquid from the surface.

In a further embodiment of the invention, I provide a method for drying a ground surface. The method includes the steps of providing liquid removal apparatus to suction liquid off the ground surface; providing heat producing apparatus to dry the ground surface; operating the liquid removal apparatus to remove a liquid from the ground surface; and, operating the heat producing apparatus to produce heat which is absorbed by the surface and promotes the evaporation of at least a portion of the liquid from the ground surface.

Figure 2:
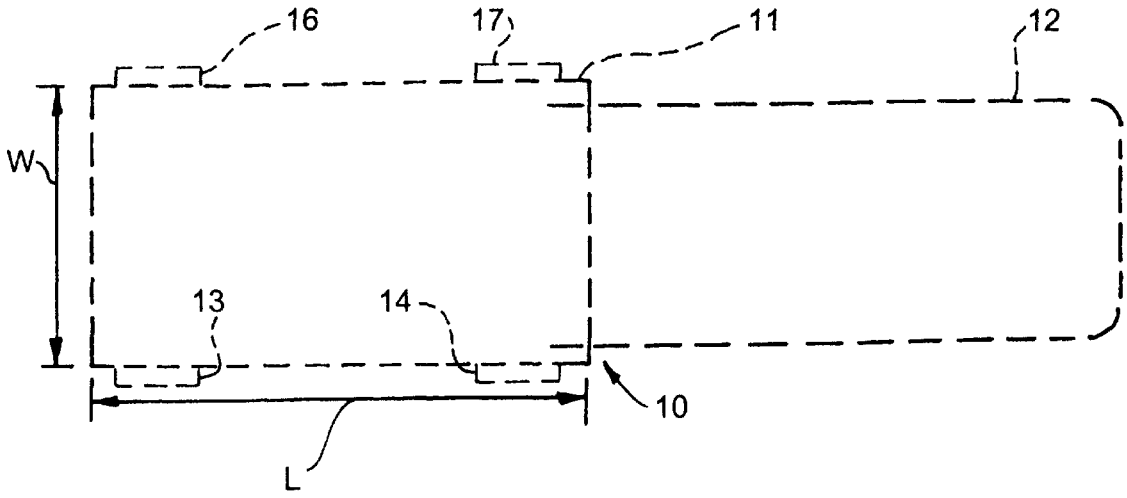

Turning now to the drawings, which depict the presently preferred embodiments and best mode of the invention for purpose of illustrating the invention and not by way of limitation of the scope of the invention, and in which:

FIG. 1 illustrates liquid removal apparatus constructed in accordance with the principles of the invention and generally identified by reference character 10; and, FIG. 2 illustrates additional structural characteristics of the apparatus of FIG. 1.

Apparatus 10 includes a frame 11. The shape and dimension of frame 11 can vary as desired, but in the embodiment of the invention illustrated in the drawing, the frame 11 is similar to the frame on a conventional "push" lawnmower which has a blade turned by a motor mounted on the lawnmower frame. One or more ground engaging wheels 13, 14, 16, 17 are rotatably mounted on frame 11 to facilitate movement of frame 11 over surface 15. The shape and dimension of wheels 13, 14, 16, 17 can vary as desired. The frame 11 in the drawing typically would utilize four wheels each spaced apart from the other and each attached at one of the four points on frame 11 lying at the corners of a rectangle interconnecting the four points.

Upstanding handle 12 is attached to frame 11 and utilized in moving frame 11 over a ground surface 15. Motive power apparatus (not shown) is provided to rotate wheels 13, 14, 16, 17 and move frame 11 over surface 15. While any desired motive power apparatus can be utilized, conventional apparatus such as either a person pushing handle 12 and frame 11, or a motor which drives and rotates wheel 13 and/or 14, 16, 17 is typically utilized. Any motor utilized on apparatus 10 can be powered by gasoline, oil, electricity, light, or any other desired means, regardless of whether the motor turns wheels 13, 14, 16, 17 or provides motive power for other apparatus mounted on apparatus 10.

The ground surface 15 on which apparatus 10 is utilized is a surface 15 on which individuals ordinarily walk or run. The composition of surface 15 can vary as desired, but the apparatus 10 is presently preferably utilized on a concrete, asphalt, or other hard surface. While apparatus 10 can be configured to vacuum gravel and other material from a surface 15, the apparatus 10 is presently intended to be used primarily to remove water from a relatively clean, smooth surface 15.

Water removal apparatus 30 is mounted on frame 11 and includes a fan 27 which produces suction that draws water or another liquid off surface 15 in the direction of arrow A and into a storage tank inside apparatus in the direction indicated by arrow C. The storage tank can be removable to facilitate emptying water from the storage tank. Air drawn upwardly in the direction of arrow A exits out through the top of apparatus 30 in the direction of arrow B. Any desired suction apparatus or other apparatus can be utilized to remove water from surface 15. It is, however, presently preferred that water removed from surface 15 be stored in apparatus 10 and not simply be directed off toward one side of surface 15. Water 26 stored in apparatus 30 can be emptied at a desired location off surface 15 or can be emptied into another container placed on or off surface 15.

Air flow—heat producing apparatus 20 is also mounted on frame 11 and includes a fan 22 which draws air in the direction of arrow D through opening 21 and downwardly in the direction of arrow E. Air traveling downwardly in the direction of arrow E splits into streams of air traveling in the directions indicated by arrows F and G through channels 60 and 61, respectively. Channel 60 is bounded by plates 62 and 63. Channel 61 is bounded by plates 64 and 65. Flames 23 heat plate 65 such that air traveling in the direction of arrow G over plate 65 is heated. If desired, the air stream traveling through channel 60 can be produced by one fan while the air stream traveling through channel 61 can be produced by a second fan. Plates 63 and 65 need not be interconnected but can be separate from one another. Heat radiates from flames 23 downwardly in the direction of arrow H and furthers evaporation of water from surface 15.

Air traveling through channel 60 in the direction of arrow F exits through mouth or opening 66 and impinges on surface 15 to facilitate the evaporation of water from surface 15 and to assist in the removal of water from nooks and crannies on surface 15.

Air traveling through channel 61 in the direction of arrow G exits through mouth or opening 40 and impinges on surface 15.

Any desired means or apparatus can be utilized to produce heat. A fan 22 or other means for producing a stream of air to convey heat is not a requisite. For example, flames 23 or a heated coil can be positioned just above surface 15 such that radiant heat emanating from flames 23 heats surface 15. Or, the flames can directly contact surface 15.

A tank 51 of propane gas mounted on frame 11 presently supplies the fuel which produces flames 23. Any engine, electrically heated apparatus, or other apparatus can be utilized to produce heat in the apparatus of the invention. An electric coil can be substituted for flames 23.

An important feature associated with the use of a tank 51 of propane is the ability to increase and decrease the flow of propane from tank 51 in order to increase or decrease the BTUs produced per minute by flames 23. While the ability to alter the BTUs per minute may not seem important, it enables the apparatus 10 to be utilized in ways apparently not anticipated by the prior art. For example, as described below, the apparatus 10 can be utilized in a variety of different weather conditions and, in particular, can be utilized to remove ice from a tennis court by operating apparatus 10 backwards. The quantity of heat required to remove ice from a tennis court is different than the quantity of heat required to remove a thin layer of water from a tennis court. The presently utilized method of altering the BTUs produced per minute by flames 23 is to operate a valve which increases or decreases the flow of gas from tank 51. Another method for altering the amount of heat discharged from mouth 40 is to utilize an adjustable damper on mouth 40 which meters the volume per minute of heated air exiting through mouth 40 and contacting surface 15. Any other desired method of varying the BTUs per minute of heat contacting surface 15 can be utilized in the practice of the invention. It is presently preferred that flames 23 produces about 500 to 10,000 BTU per minute, most preferably about 750 to 5,000 BTU per minute. At least 50%, preferably at least 70%, of the heat produced by flames 23 is directed against surface 15 by airflow from fan 22.

In order to move apparatus 10 more rapidly over surface 15 in the directions indicated by arrow T, a hotter flame can be utilized. Conversely, in order to avoid burning or otherwise damaging surface 15 with a hot flame or heat from some other source, the speed of apparatus 10 over surface 15 can be increased.

The heat directed toward surface 15 in the direction of arrow G can function to increase the evaporation of a liquid from surface 15 simply by heating the liquid or the air above surface 15, and not by heating surface 15. It is much preferred however, that heat directed against surface 15 be absorbed by surface 15 to heat surface 15 by at least five degrees, preferably at least twenty-five degrees, and most preferably by at least fifty degrees or more from the ambient temperature of surface 15 which exists prior to passing apparatus 10 over surface 15.

If desired, apparatus 30 can be mounted on one frame 11 while apparatus 20 is mounted on a separate frame 11. In this instance, apparatus 20 is moved over surface 15 after apparatus 30 is utilized to remove water from surface 15.

While it is presently envisioned that apparatus 10 be manually pushed utilizing handle 12, apparatus 10 can be configured like a riding lawnmower or other larger piece of equipment so that it provides its own motive power and a user can sit on and drive apparatus 10 over a surface 15.

In one preferred embodiment of the invention, apparatus 20 is utilized to heat surface 15 to high temperatures in excess of 150°, of 200°, of 300°, of 400°, or higher. Such high temperature greatly accelerate the drying of surface 15 and can especially be utilized when surface 15 is concrete. Concrete is highly fire-resistant. In the event surface 15 is fabricated from asphalt or other materials with a lower melting or ignition temperature than concrete, or in the event there is paint on surface 15, then care is taken not to raise the temperature of surface 15 to a level which will damage surface 15 or paint or other material applied to surface 15.

The use of a fan 22 which generates air pressures in excess of twenty-five pounds per square inch, preferably in excess of fifty pounds per square inch is presently preferred (but not required), because the air flow exiting apparatus 20 against surface 15 helps to "clean out" both water particles held in nooks and crannies in surface 15 and thin films of water covering smooth portions of surface 15. The air flow also facilitates the evaporation of water or another liquid on surface 15.

Fans 22 and 27 are operated by at least one electric motor 52. If desired, each fan 22, 27 can be provided with its own electric or other motor. Extension cord 53 connects motor 52 to a 110 V or 120 V wall outlet or to another source of electricity to operate motor 52. While an internal combustion engine can be utilized in place of electric motor 52, electric motor 52 is preferred because lubricating oil and fuel utilized in an internal combustion engine can discolor the surface 15 of a tennis court.

Although not required in the practice of the invention, the close proximity of the opening 40 (and opening 66) in apparatus 20 to surface 15 facilitates the production of higher air pressure as air traveling in the direction of arrow G and exiting opening 40 is forced intermediate the lip of opening 40 and surface 15. It is currently preferred that opening 40 (and opening 66) be about one-quarter of an inch to two inches, preferably one-half of an inch to one inch, away from surface 15. Similarly, opening 50 is preferably about one-sixteenth of an inch (or closer) to one-half of an inch from surface 15 to facilitate the removal by apparatus 30 of a liquid from surface 15. As will be described below, when felt strips or rubber flaps 53 and 54 are utilized, opening 50 may be spaced three or more inches about surface 15.

Front wheels 13, 16 preferably, but not necessarily, freely caster or rotate about an axis perpendicular to surface 15 and to the horizontal axis about which a wheel 13,16 rotates. Caster wheels facilitate turning apparatus 10 without having to lift wheels 13,16 off the ground and pivot apparatus 10 on rear wheels 14 and 17. Pivoting apparatus 10 on rear wheels 14,17 causes wheels 14,17 to carry more weight and increases the likelihood that the rubber, polyurethane, or other polymer material comprising wheels 14, 17 will abrade on the surface 15 of a tennis court and leave a marks on the court. Leaving scuff or skid marks on the surface 15 of a tennis court defaces surface 15 and is a problem when surface 15 comprises a tennis court at a resort or tennis facility which must continually remove marks which partially cover and obliterate the lines or other portions of the tennis court.

Friction between a pair of surfaces is indicated by the coefficient of friction. The coefficient of friction is the ratio between the force required to move two surfaces in contact with each other and the force holding the two surface together. There are two kinds of friction, sliding friction and rolling friction. The resistance in sliding friction is caused by the interference of irregularities on two contacting surfaces. The resistance in rolling friction is caused by the interference of small indentations formed as one surface rolls over another. In both sliding friction and rolling friction, molecular attraction between two opposing surfaces causes some "frictional" resistance. If a one hundred pound weight is resting on a flat surface and a force of twenty pounds is required to slide the weight along the surface, the coefficient of friction between the weight and surface is twenty divided by one hundred, or 0.2. When two well oiled metallic surfaces contact each other, the coefficient of sliding friction between the surfaces is in the range of 0.01 to 0.05. The coefficient of rolling friction between a ball bearing and a bearing race is typically about 0.002. The apparatus of the invention is intended to be utilized on concrete, asphalt, acrylic or other hard tennis court surfaces which produce a coefficient of friction of at least 0.2, preferably at least 0.4, when a conventional rubber or polymer soled tennis shoe is utilized. Such cementicious type surfaces typically are not polished or smooth or waxed to cause a tennis player to slide over the surfaces as he runs around a court returning and making tennis shots. In contrast, a clay tennis court includes a layer of loose clay or gravel which enables a player to slide much more readily over the court surface. The apparatus 10 of the invention is not intended for clay tennis court surfaces or other court surfaces which have loose particulate on the surfaces to facilitate sliding over the surfaces. As used herein, a cementicious type tennis court surface is a continuous hard surface of concrete, asphalt, acrylic, or another hard material which—in combination with the sole of at least 75% of tennis shoes commonly utilized today—produces a coefficient of friction in excess of 0.2, preferably 0.4. Since one primary and important function of tennis shoes is to provide a rubber or rubber-like sole which "grips" a cementicious court surface and does not slide when the player wearing the shoes runs over the cementicious court, it is likely that nearly all or all tennis shoes produce a coefficient of friction in excess of 0.2 when used on a cementicious tennis court. In the practice of the invention, the wheels 13, 14, 16, 17 when used on and contacting a cementicious court must, in combination with the cementicious court, produce a coefficient of friction of at least 0.1, preferably at least 0.4.

In the Mohs scale, talc has a hardness of 1; gypsum has a hardness of 2; calcite has a hardness of 3; fluorite has a hardness of 4; apatite has a hardness of 5; orthoclase has a hardness of 6; quartz has a hardness of 7; topaz has a harness of 8; corundum has a hardness of 9; and diamond has a hardness of 10. If wheels 13, 14, 16, 17 are too hard, they may slip over cementicious surface 15 or may score or damage surface 15, both of which results are undesirable. If wheels 13, 14, 16, 17 are too soft, it is more likely the wheels will readily abrade or tear and mark the surface 15 of a cementicious tennis court. Accordingly, it is presently preferred that wheels 13, 14, 16, 17 have a Mohs hardness in the range of 1 to 8, most preferably in the range of 2 to 7.

When small or thin pieces of plastic or rubber abrade or fall off a larger original piece of material, the small piece of material often appears clear or white, even though the original piece of material appears to be blue, green, black, or some other color. Consequently, one possible way to minimizing the defacing of a tennis court is to insure that as a wheel 13, 14, 16, 17 abrades and wears, the size of the pieces of material which abrade off a wheel 13, 14, 16, 17 are relatively small. Consequently, in the practice of the invention, it is preferred that at least 90% of the pieces of material which abrade of a wheel 13, 14, 16, 17 when apparatus 10 is utilized on a cementicious tennis court have a size in the range of 0.001 millimeter to 2.00 millimeters, preferably 0.0001 to 0.5 millimeter. The size of particles which wear off a wheel 13, 14, 16, 17 rolling over a cementicious tennis court is readily determined by running apparatus 10 with wheels 13, 14, 16, 17 up and down a path on a tennis court which was earlier cleaned, by vacuuming up the particulate which abraded off wheels 13, 14, 16, 17, and by then sizing the vacuumed up particulate.

Another method of preventing wheels 13, 14, 16, 17 from discoloring a cementicious surface 15 of a tennis court is to utilize in said wheels a dye or other coloring agent which will not "bleed" out of a wheel 13, 14, 16, 17 or otherwise discolor surface 15 during normal utilization of apparatus 13, 14, 16, 17. The dye in a wheel can be readily tested by utilizing apparatus 10 on the surface 15 of a cementicious tennis court during the weather conditions normally encountered during use of apparatus 10.

A further factor in preventing wheels 13, 14, 16, 17 from discoloring a cementicious surface 15 of a tennis court is to utilize in said wheels a material(s) which, when said wheels abrade or otherwise wear, produces particles that do not adhere to surface 15. Sometimes a particle abraded from a wheel 13, 14, 16, 17 can not be readily removed from surface 15 simply because the particle is, without the particle being deformed, wedged or forced into an opening in surface 15. Such a wedged particle is not, for purposes herein, the wedged particle is not deemed to "adhere" to surface 15. As used herein, a particle adheres to surface 15 if the particle sticks to surface 15 because the particle is sticky or gummy, because the particle has an electrostatic or other electric charge which make the particle bond to surface 15, or, because the particle deforms (if for example the particle is soft and malleable) or smears around portions of surface 15.

The width, indicated by arrows W in FIG. 2, of apparatus 10 is in the range of about eighteen to forty-six inches, preferably about twenty-four to forty-two inches. These dimensions were determined by experimentation. In the event that wheels 13, 14, 16, 17 or any of the other components of apparatus 10 are wider than frame 11, then it is understood as utilized herein that the "width" of apparatus 10 includes any such additional width. For example, (1) if the width, W, of frame 11 is twenty-four inches and the width of each wheel 13, 14, 16, 17 is two inches, (2) if each wheel 13, 14, 16, 17 is attached to a side of frame 11 in the manner shown in FIG. 2 and extends laterally out from frame 11 a distance of three inches, (3) if suction unit 30 and heater 20 do not extend out laterally past the sides of frame 11, and (4) if handle 12 is narrower than frame 11 in the manner illustrated in FIG. 2, then the width, W, of apparatus 10 equals the width of frame 11 (twenty-four inches) plus the distance that a wheel 16, 17 extends out laterally from frame 11 (three-inches) plus the distance that a wheel 13, 14 extends out laterally from frame 11 (three inches). The width, W, of apparatus 10 is therefore thirty inches.

The width of opening or mouth 50 is in the range of about twelve to forty-six inches, preferably about eighteen to forty-two inches.

Mouth 50 includes front 56 and rear 55 parallel edges. Elongate rectangular felt strip 53 is attached to and extends along about the entire length of rear edge 55. Elongate rectangular felt strip 54 is attached to and extends along about the entire length of front edge 56. Strip 53 is parallel to strip 54. The length of each strip 54, 55 is in the range of twelve to forty-six inches, preferably eighteen to forty-two inches. The height of each strip 53, 54 (i.e., the distance from edges 55 and 56, respectively, to surface 15) can vary from about one-sixteenth of an inch to four inches, preferably from about one-quarter of an inch to two inches. Each felt strip presently, but not necessarily, contacts surface 15 and is dragged over surface 15 during movement of apparatus 10 over surface 15 in the directions indicated by arrows T. Strips 53, 54 can be fabricated out of any desired material and can be rigid or pliable, but presently are preferably pliable fabric or rubber strips. Strips 53, 54 function to increase the suction force acting on surface 15 immediately below opening 50. The distance between strips 53, 54 can vary as desired. There should, however, be a space intermediate strips 53, 54. If strips 53, 54 are pulled together, they interfere with the removal of liquid from surface 15.

In use, water removal apparatus 30 is turned on and the air flow/heat producing apparatus 20 is turned on. A user grasps handle 12 and pushes apparatus 10 forward over surface 15 such that opening 50 first suctions water upwardly off a selected portion of surface 15. Fan 22 directs cool air in the direction of arrow F through opening 66 and against surface 15 to evaporate water from surface 15 and move water from nooks and crannies on surface 15. Radiant heat emanating in the direction of arrow H from flames 23 facilitates the further evaporation of water from surface 15 to dry surface 15. Heated air exiting downwardly through mouth 40 further facilitates the evaporation of water from surface 15 and the movement of water from nooks and crannies in surface 15.

Applying a stream of air to surface 15 via mouth 66 prior to apply heated air via mouth 40 has been found important in the practice of the invention. The air stream exiting mouth 66 functions to evaporate water and, likely, to produce small droplets or mists of water which are airborne and which carry water away from surface 15. As a result, the amount of water which must be evaporated by heated air exiting mouth 40 is significantly decreased. While air exiting mouth 66 can also, if desired, be heated, using air which has an ambient temperature or even cooler facilitates the drying of surface 15. Similarly, if desired, heated air can be directed through mouth 66 and cooler air can be directed through mouth 40. It is presently preferred, however, that the application of heated air to surface 15 be subsequent to the application of cooler air through mouth 66.

Positioning flames 23 close enough to surface 15 such that radiant heat from flames 23 facilitates the drying of surface 15 has been found important in the practice of the invention. Any amount of water evaporated by flame 23 reduces the amount of evaporation which must be carried out by heated air exiting mouth 40. Heated air exiting mouth 40 impinges surface 15 and preferably completely or substantially dries surface 15. Flames 23 can also be positioned close enough to surface 15 to actually contact surface 15.

In another novel method of the invention, apparatus is utilized to remove ice from a cementicious tennis court. In this method, apparatus 20 and 30 are turned on, a user grasps handle 12, and the user pulls apparatus 20 backwards in the direction of arrow S. Heat exiting mouth 40 contacts and melts ice on surface 15 to produce water on surface 15. Suction generated by apparatus 30 then draws water off surface 15 and into the storage tank mounted on frame 11. After substantially all ice is removed from surface 15 by moving apparatus 10 backwards in the direction of arrow S to melt the ice and suction off the water produced by melting the ice, apparatus can again be moved over surface 15 forward in a direction opposite that of arrow S or can be moved over surface 15 in the direction of arrow S such that heat from apparatus 20 evaporates any small amounts of water or ice remaining on surface 15. When apparatus 10 is utilized to remove ice from a cementicious tennis court surface or other surface, it is anticipated that the BTUs per minute of heat generated by apparatus 20 will, in at least some circumstances, have to be increased in comparison to the amount of heat generated when apparatus 10 is being utilized simply to remove water from a surface 15.

Sensor 70 monitors the temperature of surface 15. In the event the temperature of surface 15 exceeds a selected value, sensor 70 transmits a message to a valve on propane tank 51 which causes the valve to close to turn off flame 23. In this manner, sensor 70 prevents surface 15 from being damaged in the event apparatus 10 is left stationary and "running" for a period of time or in the event the amount of heat produced by flame 23 significantly exceeds the intended amount of heat.

Having described my invention in such terms as to enable those skilled in the art to understand and practice it, and having identified the presently preferred embodiments thereof, I claim:

1. Apparatus for drying a ground surface, said apparatus including (a) a frame;

(b) at least one ground engaging wheel mounted on said frame to support said frame above the surface and facilitate movement of said frame over the surface;

(c) water removal means mounted on said frame to remove water from the surface; and, (d) air flow means for directing (i) a first stream of air against the ground surface to promote the evaporation of water from the surface; and, (ii) a second heated stream of air against the ground surface to promote the evaporation of water from the surface.

2. A method for drying a ground surface, said method including the steps of (a) moving liquid removal apparatus over the ground surface to suction liquid from the ground surface;

(b) moving air stream apparatus over the ground surface to direct a first stream of air against the ground surface to facilitate evaporation of the liquid from the ground surface;

(c) moving air stream apparatus over the ground surface to direct a second stream of heated air against the ground surface to facilitate evaporation of the liquid from the ground surface.

3. A method for drying a ground surface, said method including the steps of (a) moving liquid removal apparatus over the ground surface to suction liquid from the ground surface;

(b) moving flame means over the ground surface to direct radiant heat against the ground surface to facilitate evaporation of the liquid from the ground surface;

(c) moving air stream apparatus over the ground surface to direct heated air against the ground surface to facilitate evaporation of the liquid from the ground surface.

* * * * *